US007395616B2

(12) United States Patent
Fallon

(10) Patent No.: US 7,395,616 B2
(45) Date of Patent: Jul. 8, 2008

(54) ARTICLE OF FOOTWEAR WITH A PIVOTING SOLE ELEMENT

(75) Inventor: Kevin Patrick Fallon, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 373 days.

(21) Appl. No.: 11/251,545

(22) Filed: Oct. 14, 2005

(65) Prior Publication Data

US 2007/0084081 A1 Apr. 19, 2007

(51) Int. Cl.
*A43B 21/26* (2006.01)

(52) U.S. Cl. ..... 36/35 R; 36/29; 36/25 R; 36/35 B

(58) Field of Classification Search ..... 36/7.8, 36/27, 29, 35 R, 103, 35 B, 25 R
See application file for complete search history.

(56) References Cited

U.S. PATENT DOCUMENTS

| | | | | | |
|---|---|---|---|---|---|
| 337,146 | A * | 3/1886 | Gluecksmann | 36/7.8 |
| 2,048,683 | A * | 7/1936 | Brockman | 36/35 R |
| 2,299,009 | A * | 10/1942 | Denk | 36/36 R |
| 2,814,132 | A | 11/1957 | Montoscuro | |
| 3,377,723 | A | 4/1968 | England | |
| 3,739,500 | A | 6/1973 | Cox | |
| 3,822,490 | A * | 7/1974 | Murawski | 36/105 |
| 4,449,307 | A | 5/1984 | Stubblefield | |
| 4,546,556 | A | 10/1985 | Stubblefield | |
| 4,550,510 | A | 11/1985 | Stubblefield | |
| 5,435,079 | A | 7/1995 | Gallegos | |
| 5,794,359 | A | 8/1998 | Jenkins et al. | |
| 5,806,209 | A * | 9/1998 | Crowley et al. | 36/28 |
| 6,145,867 | A | 11/2000 | Bourdeau | |
| 7,080,467 | B2 * | 7/2006 | Marvin et al. | 36/29 |
| 2002/0144430 | A1 | 10/2002 | Schmid | |
| 2005/0120592 | A1 * | 6/2005 | Rodriguez | 36/35 R |
| 2005/0166422 | A1 * | 8/2005 | Schaeffer et al. | 36/27 |

FOREIGN PATENT DOCUMENTS

EP 0 174 878 A2 6/1985

OTHER PUBLICATIONS

International Search Report dated Jan. 29, 2007.

* cited by examiner

*Primary Examiner*—Ted Kavanaugh
(74) *Attorney, Agent, or Firm*—Banner & Witcoff, Ltd.

(57) ABSTRACT

An article of footwear is disclosed that has a sole structure with a sole element and a coupling. The sole element is spaced from a remainder of the footwear to define a space between a portion of the sole element and the remainder of the footwear. The coupling extends upward from the sole element to join the sole element with the remainder of the footwear. The coupling is spaced from the periphery of the sole element, and the coupling is the only attachment point between the sole element and the remainder of the footwear. In operation, the coupling permits the sole element to pivot in relation to the remainder of the footwear.

42 Claims, 13 Drawing Sheets

ARTICLE OF FOOTWEAR WITH A PIVOTING SOLE ELEMENT

BACKGROUND

Conventional articles of athletic footwear include two primary elements, an upper and a sole structure. The upper provides a covering for the foot that comfortably receives and securely positions the foot with respect to the sole structure. The sole structure is secured to a lower portion of the upper and is generally positioned between the foot and the ground. In addition to attenuating ground reaction forces, the sole structure may provide traction, control foot motions (e.g., by resisting over pronation), and impart stability, for example. Accordingly, the upper and the sole structure operate cooperatively to provide a comfortable structure that is suited for a wide variety of athletic activities.

The sole structure generally incorporates multiple layers that are conventionally referred to as an insole, a midsole, and an outsole. The insole is a thin, compressible member located within the upper and adjacent to a plantar (i.e., lower) surface of the foot to enhance footwear comfort. The midsole, which is conventionally secured to the upper along the length of the upper, forms a middle layer of the sole structure and is primarily responsible for attenuating ground reaction forces. The outsole forms the ground-contacting element of footwear and is usually fashioned from a durable, wear-resistant material that includes texturing to improve traction.

The conventional midsole is primarily formed from a resilient, polymer foam material, such as polyurethane or ethylvinylacetate, that extends throughout the length of the footwear. The properties of the polymer foam material in the midsole are primarily dependent upon factors that include the dimensional configuration of the midsole and the specific characteristics of the material selected for the polymer foam, including the density of the polymer foam material. By varying these factors throughout the midsole, the relative stiffness and degree of ground reaction force attenuation may be altered to meet the specific demands of the activity for which the footwear is intended to be used.

In addition to polymer foam materials, conventional midsoles may include, for example, one or more fluid-filled bladders and moderators.

SUMMARY

An aspect of the invention is an article of footwear having an upper and a sole structure secured to the upper. The sole structure includes a sole element and a coupling. The sole element is spaced from a remainder of the footwear to define a space between a portion of the sole element and the remainder of the footwear. The coupling extends from a surface of the sole element to join the sole element with the remainder of the footwear.

The coupling may be spaced from the periphery of the sole element, and the coupling may be the only attachment point between the sole element and the remainder of the footwear. In operation, the coupling permits the sole element to pivot in relation to the remainder of the footwear.

The advantages and features of novelty characterizing various aspects of the invention are pointed out with particularity in the appended claims. To gain an improved understanding of the advantages and features of novelty, however, reference may be made to the following descriptive matter and accompanying drawings that describe and illustrate various embodiments and concepts related to the aspects of the invention.

DESCRIPTION OF THE DRAWINGS

The foregoing Summary, as well as the following Detailed Description, will be better understood when read in conjunction with the accompanying drawings.

DETAILED DESCRIPTION

The following discussion and accompanying figures disclose various embodiments of a sole structure for an article of footwear. Concepts related to the sole structure are disclosed with reference to footwear having a configuration that is suitable for the sport of basketball. The sole structure is not limited solely to footwear designed for basketball, however, and may be applied to a wide range of athletic footwear styles, including tennis shoes, football shoes, cross-training shoes, walking shoes, soccer shoes, and hiking boots, for example. The sole structure may also be applied to footwear styles that are generally considered to be non-athletic, including dress shoes, loafers, sandals, and work boots. An individual skilled in the relevant art will appreciate, therefore, that the concepts disclosed herein apply to a wide variety of footwear styles, in addition to the specific style discussed in the following material and depicted in the accompanying figures.

Figure 1:
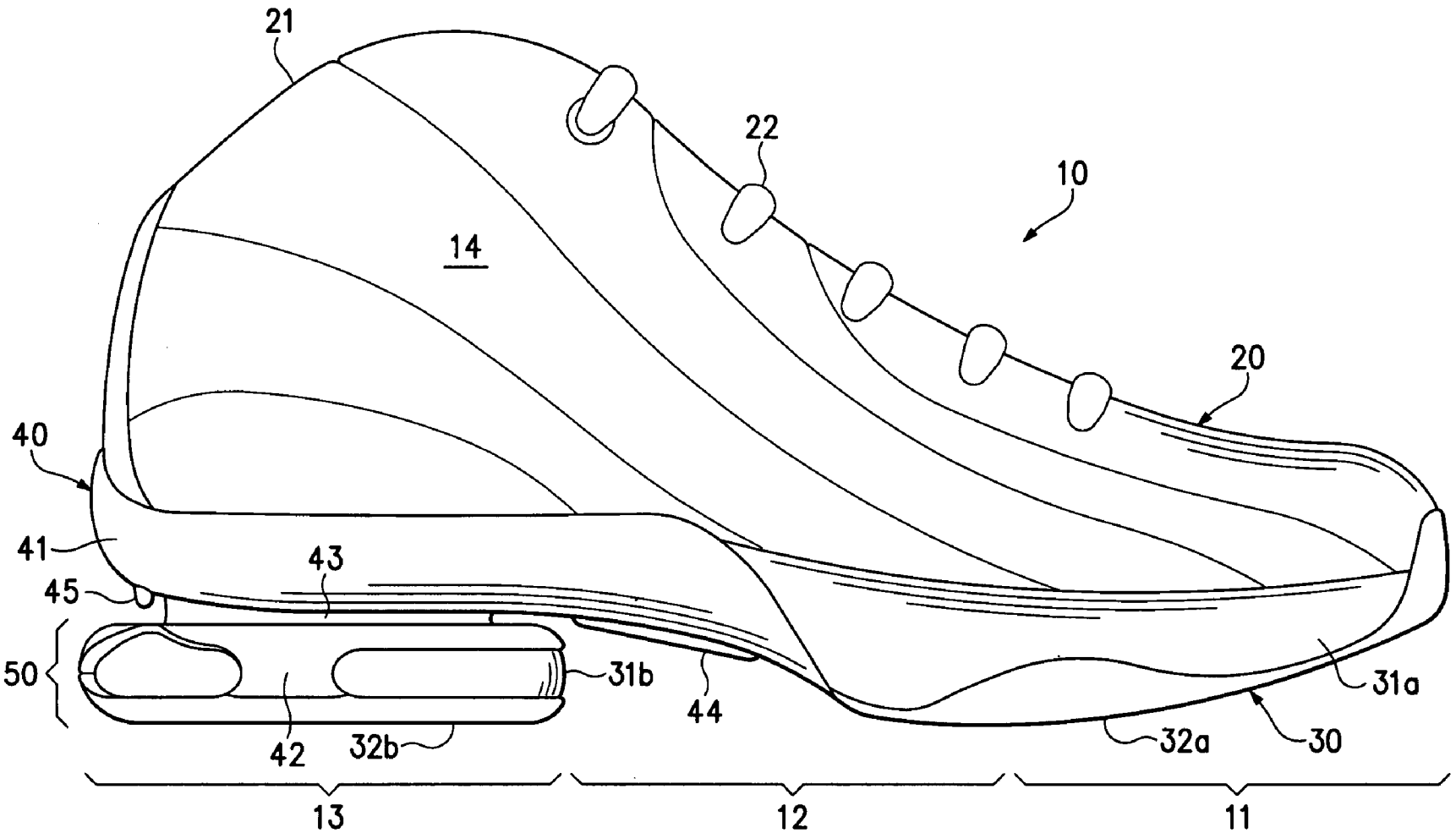
FIG. 1 is lateral side elevational view of an article of footwear.
Figure 2:
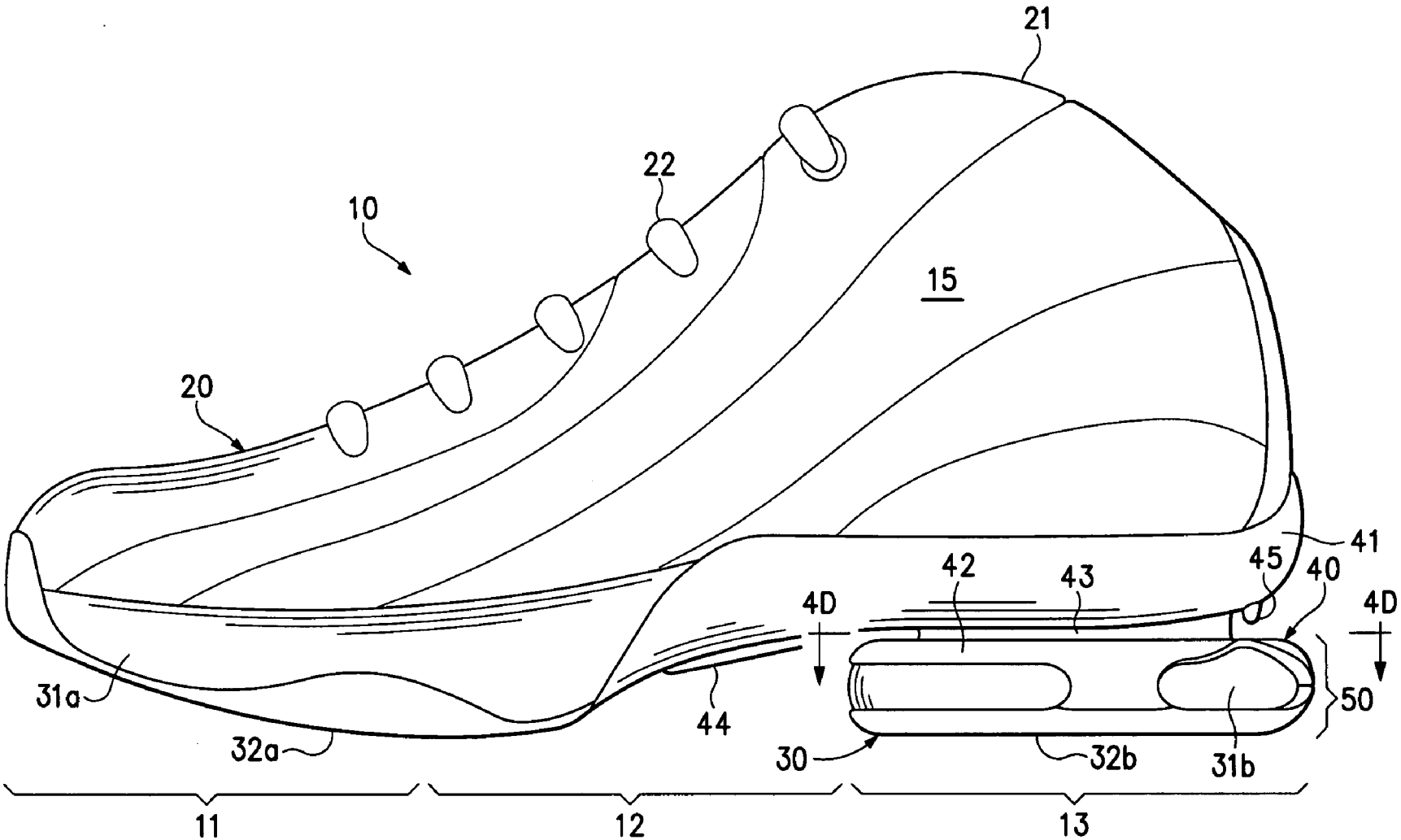
FIG. 2 is a medial side elevational view of the article of footwear.

An article of footwear 10 is depicted in FIGS. 1 and 2 as including an upper 20 and a sole structure 30. For reference purposes, footwear 10 may be divided into three general regions: a forefoot region 11, a midfoot region 12, and a heel region 13, as shown in FIGS. 1 and 2. Footwear 10 also includes a lateral side 14 and a medial side 15. Forefoot region 11 generally includes portions of footwear 10 corresponding with the toes and the joints connecting the metatarsals with the phalanges. Midfoot region 12 generally includes portions of footwear 10 corresponding with the arch area of the foot, and heel region 13 corresponds with rear portions of the foot, including the calcaneus bone. Lateral side 14 and medial side 15 extends through each of regions 11-13 and correspond with opposite sides of footwear 10. Regions 11-13 and sides 14-15 are not intended to demarcate precise areas of footwear 10. Rather, regions 11-13 and sides 14-15 are intended to represent general areas of footwear 10 to aid in the following discussion. In addition to footwear 10, regions 11-13 and sides 14-15 may also be applied to upper 20, sole structure 30, and individual elements thereof.

Upper 20 is depicted as having a substantially conventional configuration that incorporates a plurality material elements (e.g., textiles, foam, leather, and synthetic leather) stitched or adhesively bonded together to form an interior void for securely and comfortably receiving a foot. The material elements may be selected and located with respect to upper 20 in order to selectively impart properties of durability, air-permeability, wear-resistance, flexibility, and comfort, for example. The material elements form a structure that defines an interior void for receiving the foot. An ankle opening 21 in heel region 13 provides access to the interior void. In addition, upper 20 may include a lace 22 that is utilized in a conventional manner to modify the dimensions of the interior void, thereby securing the foot within the interior void and facilitating entry and removal of the foot from the interior void. Lace 22 may extend through apertures in upper 20, and a tongue portion of upper 20 may extend between the interior void and lace 22. Given that various aspects of the present application primarily relate to sole structure 30, upper 20 may exhibit the general configuration discussed above or the general configuration of practically any other conventional or non-conventional upper. Accordingly, the structure of upper 20 may vary significantly within the scope of the present invention.

Sole structure 30 is secured to upper 20 and has a configuration that extends between upper 20 and the ground. In forefoot region 11 and forward portions of midfoot region 12, sole structure 30 includes a midsole element 31*a* and an outsole element 32*a*. Midsole element 31*a* may be formed from a polymer foam material, such as polyurethane or ethylvinylacetate, that attenuates ground reaction forces when forefoot region 11 is compressed between the foot and the ground. In addition to the polymer foam material, midsole element 31*a* may incorporate a fluid-filled chamber, as disclosed in U.S. Pat. No. 4,183,156 to Rudy, for example, to further enhance the ground reaction force attenuation characteristics of sole structure 30. Outsole element 32*a* is secured to a lower surface of midsole element 31*a* and may extend onto side areas of midsole element 31*a*. Outsole element 32*a* may be formed from a rubber material that provides a durable and wear-resistant surface for engaging the ground. In addition, outsole element 32*a* may be textured to enhance the traction (e.g., friction) properties between footwear 10 and the ground.

With reference to heel region 13, sole structure 30 includes a midsole element 31*b*, an outsole element 32*b*, and a pivot element 40. Each of midsole element 31*b* and outsole element 32*b* may have the general characteristics of midsole element 31*a* and outsole element 32*b*, as discussed above. Accordingly, midsole element 31*b* may be formed from a polymer foam material that attenuates ground reaction forces, and midsole element 31*b* may incorporate a fluid-filled chamber to further enhance the ground reaction force attenuation characteristics of sole structure 30. Outsole element 32*b* is secured to a lower surface of midsole element 31*b* and may be formed from a rubber material that provides a durable and wear-resistant surface for engaging the ground. In addition, outsole element 32*b* may be textured to enhance the traction (e.g., friction) properties between footwear 10 and the ground.

Figure 3:
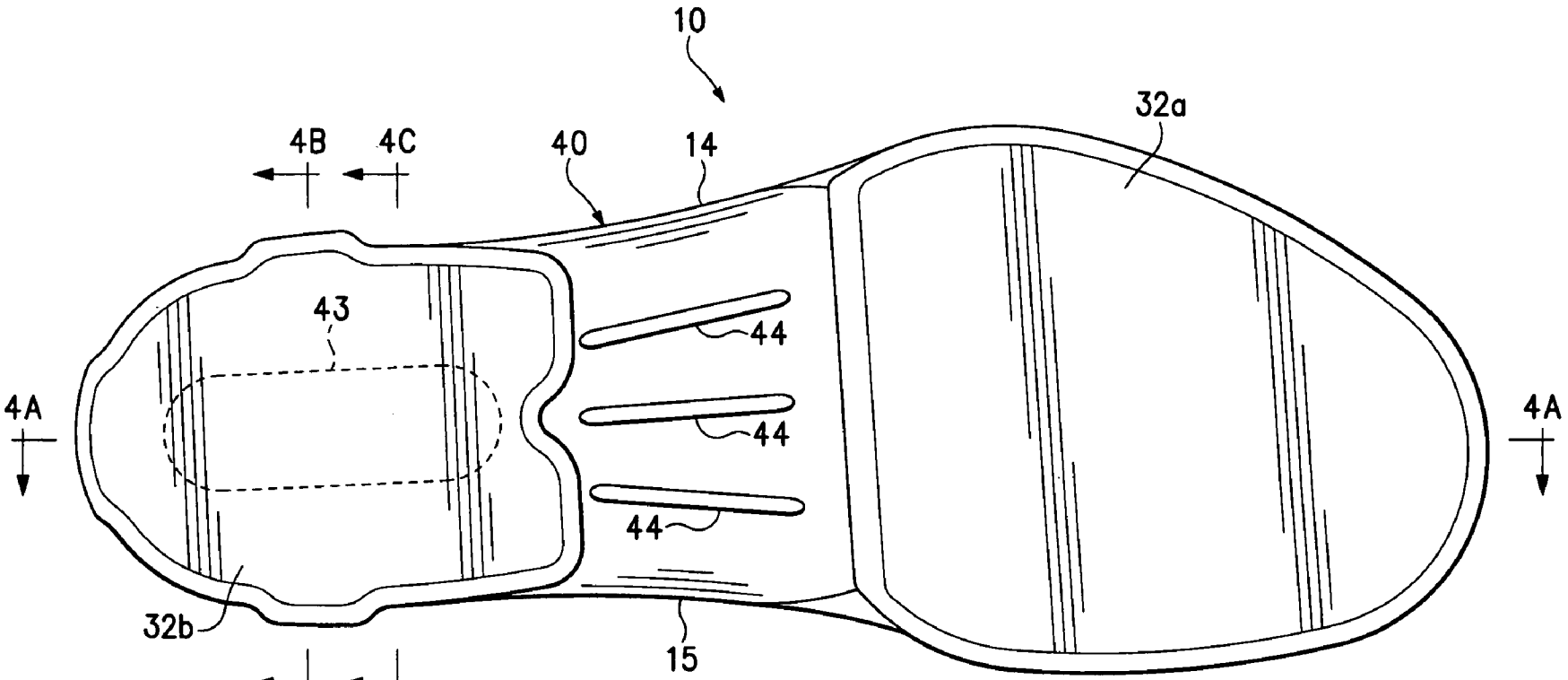
FIG. 3 is a bottom plan view of the article of footwear.

Whereas midsole element 31*a* is secured directly to a lower portion of upper 20, midsole element 31*b* is secured to pivot element 40, which is, in turn, secured to the lower portion of upper 20. Pivot element 40 includes an upper support 41, a lower support 42, and a coupling 43. Upper support 41 is secured to upper 20 and has a rounded or otherwise concave configuration that extends onto sides of upper 20. More particularly, the concave configuration of upper support 41 extends around heel region 13 and onto sides 14-15 to resist movement in the heel of the foot received by upper 20. Although the concave configuration of upper support 41 assists with stabilizing the foot, upper support 41 may have a more planar configuration in some embodiments. Additionally, upper support 41 extends into midfoot region 12 and curves downward to join with rear portions of midsole element 31*a*. In some embodiments, upper support 41 may be limited to heel region 13 or may extend through each of regions 11-13 (i.e., through substantially all of the length of footwear 10). Upper support 41 may also include various ribs 44, as depicted in FIG. 3, that resist bending in upper support 41.

Figure 4A:
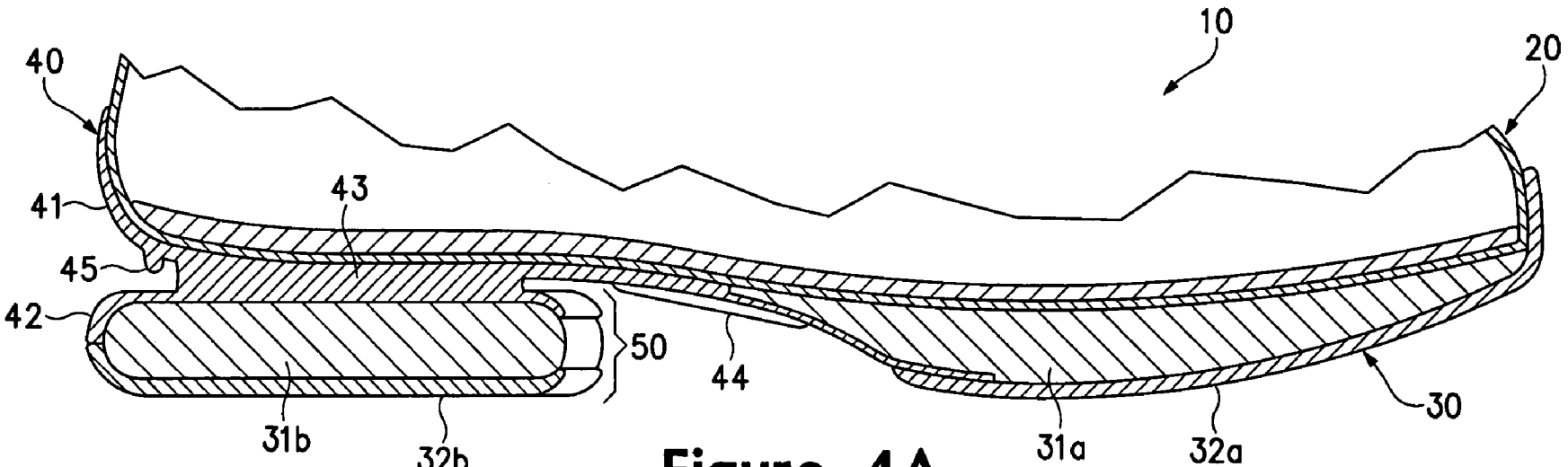
FIG. 4A is a first cross-sectional view of the article of footwear, as defined by section line 4A-4A in FIG. 3.
Figure 4B:
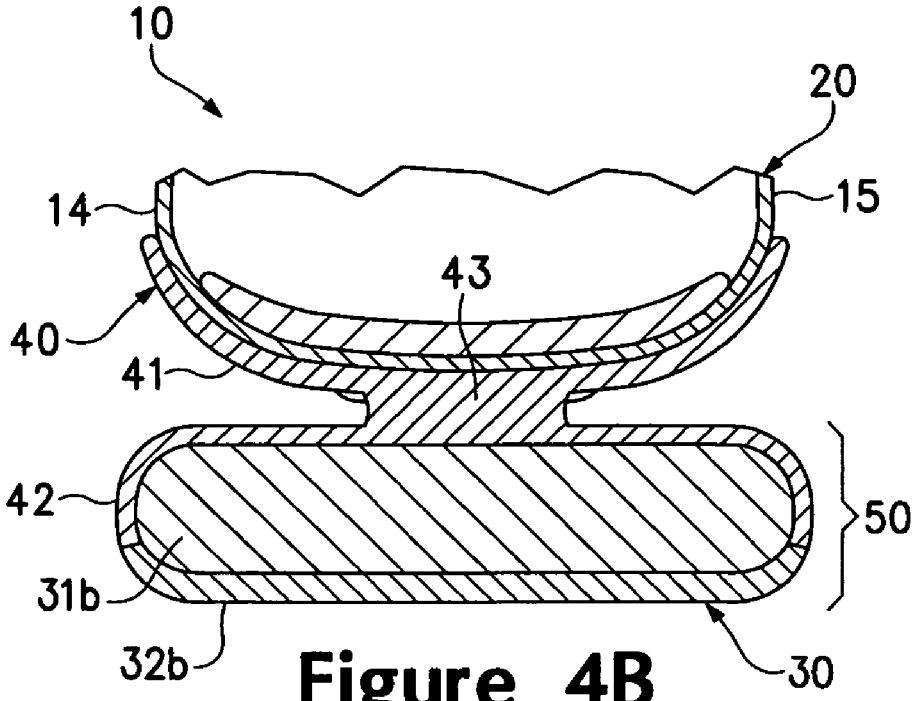
FIG. 4B is a second cross-sectional view of the article of footwear, as defined by section line 4B-4B in FIG. 3.
Figure 4C:
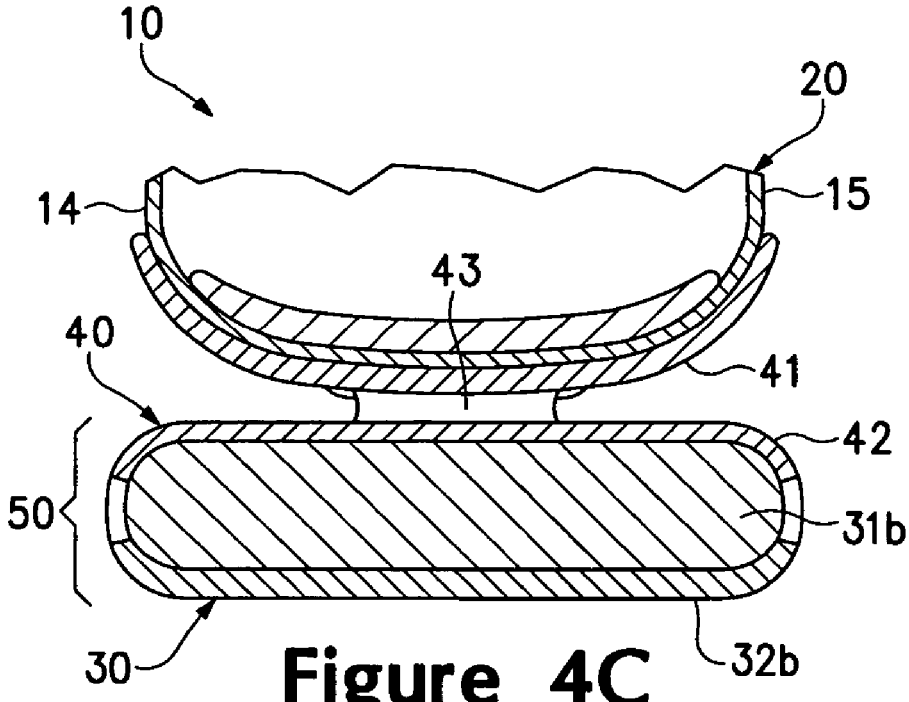
FIG. 4C is a third cross-sectional view of the article of footwear, as defined by section line 4C-4C in FIG. 3.

Lower support 42 is spaced downward from upper support 41, as depicted in FIGS. 4A-4C, to form a space or air gap between upper support 41 and lower support 42. Upper support 41 and lower support 42 are aligned so that the space or air gap has a relatively constant dimension. Although upper support 41 and lower support 42 may be substantially parallel to each other, upper support 41 and lower support 42 may also be angled. Whereas upper support 41 extends into midfoot region 12 and joins with midsole element 31*a*, lower support 42 is primarily located in heel region 13. Lower support 42 is secured to an upper surface of midsole element 31*b* and has a shape that generally corresponds with midsole element 31*b*. Although lower support 42 may have a planar configuration, lower support 42 is depicted as extending over the upper surface of midsole element 31*b* and curving downward to extend along sides of midsole element 31*b* to join with outsole element 32*b*. In areas where lower support 42 is absent from the sides of midsole element 31*b*, portions of midsole element 31*b* are exposed.

Coupling 43 extends between upper support 41 and lower support 42 to form the only attachment point between upper support 41 and lower support 42. In general, coupling 43 is spaced inward from each of lateral side 14, medial side 15, and the rear surface of footwear 10. More particularly, coupling 43 is positioned at an approximate center between lateral side 14 and medial side 15. In relation to lower support 42, for example, coupling 43 is spaced inward from a periphery of lower support 42 and is located in a central area of lower support 42. Similarly, coupling 43 is spaced inward from a periphery of upper support 41. In some footwear configurations, however, coupling 43 may be offset from the central area of lower support 42, offset from the approximate center between lateral side 14 and medial side 15, or adjacent to the periphery of lower support 42, for example.

Figure 4D:
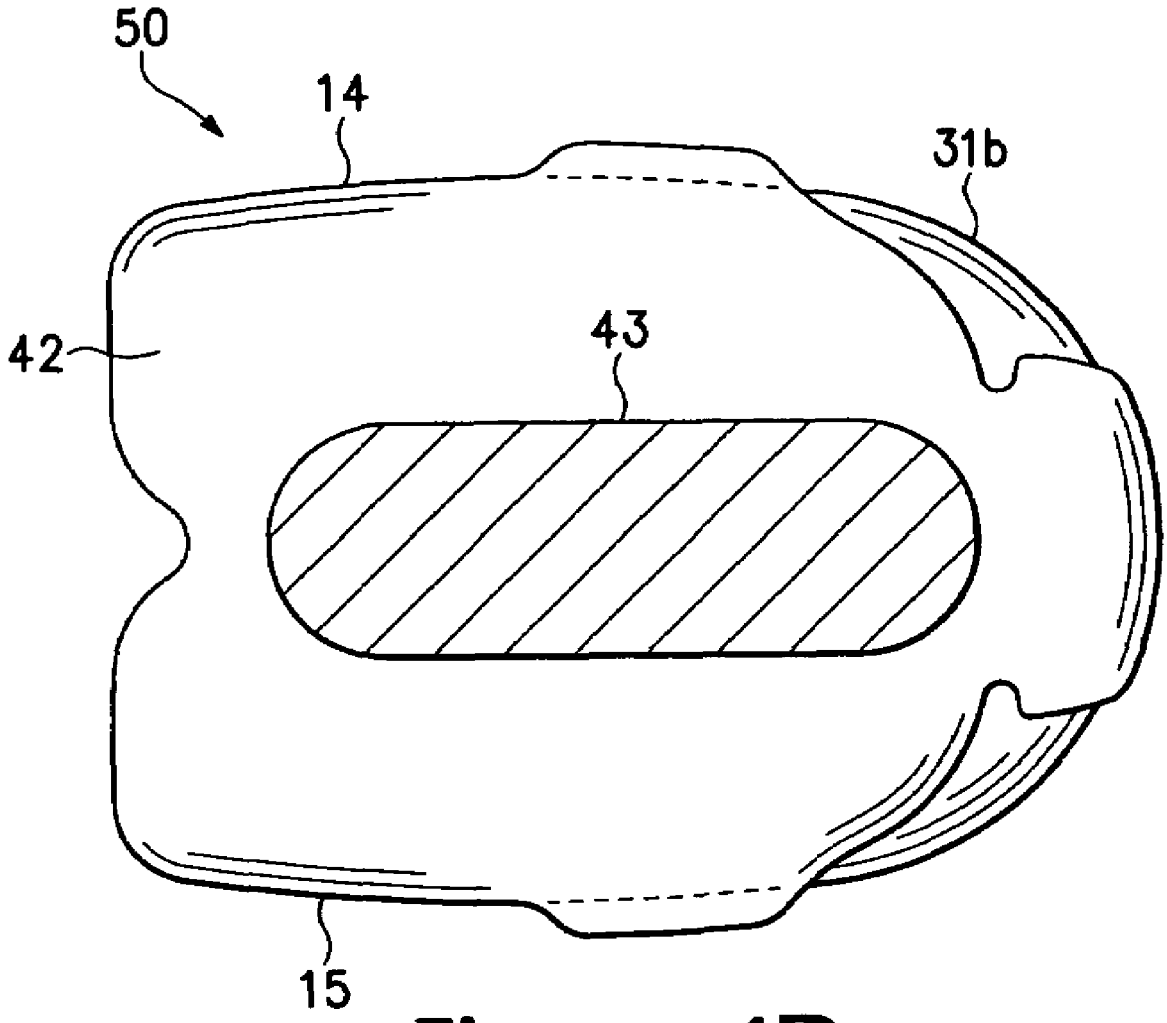
FIG. 4D is a fourth cross-sectional view of the article of footwear, as defined by section line 4D-4D in FIG. 2.

Pivot element 40 has a configuration that permits upper support 41 to pivot in relation to lower support 42 about coupling 43. That is, coupling 43, which is the only attachment point between upper support 41 and lower support 42, acts as a pivot point between upper support 41 and lower support 42. With reference to FIG. 4D, coupling 43 is depicted as having a length that is greater than a width. More particularly, a length dimension of coupling 43, which corresponds with a direction extending along a longitudinal axis of footwear 10, is greater than a width dimension of coupling 43, which corresponds with a direction extending between sides 14 and 15. The differences between the length and width of coupling 43 have an effect upon the pivoting motion between upper support 41 and lower support 42. Although coupling 43 permits some degree of pivoting motion in the forward-rearward direction, the lesser width dimension facilitates greater pivoting in a side-to-side direction (i.e., toward either of lateral side 14 and medial side 15).

Accordingly, coupling 43 permits upper support 41 and lower support 42 to pivot in at least the side-to-side direction. When incorporated into footwear 10, therefore, pivot element 40 facilitates a pivoting movement between upper 20 and portions of sole structure 30 in at least heel region 13.

As discussed above, lower support 42 is spaced downward from upper support 41 to form a space or air gap between upper support 41 and lower support 42. The degree to which upper support 41 may pivot in relation to lower support 42, and the degree to which the remainder of footwear 10 may pivot in relation to sole element 50, is at least partially dependent upon the dimensions of the space. More particularly, as the space increases in size, the degree of pivoting increases. Similarly, as the space decreases in size, the degree of pivoting decreases. The overall height of coupling 43, in addition to other factors, has an effect upon the dimensions of the space. Depending upon the specific athletic activity for which footwear 10 is intended to be used, the dimension of the space may range from one to twenty millimeters, for example. In some articles of footwear, however, the dimension of the space may exceed this range.

Pivot element 40 may be molded from a polymer material such that upper support 41, lower support 42, and coupling 43 are formed of unitary (i.e., one piece) construction. The material forming pivot element 40 may generally exhibit a semi-rigid structure that resists significant deformation, except at coupling 43, to ensure that pivoting between upper support 41 and lower support 42 occurs, as discussed in greater detail below. Although pivot element 40 may be formed from a variety of materials, the rigidity of the material forming pivot element 40 will generally be greater than the rigidity of the material forming midsole element 31*b*, for example.

A variety of materials are suitable for pivot element 40, including polyester, thermoset urethane, thermoplastic urethane, various nylon formulations, blends of these materials, or blends that include glass fibers. In addition, pivot element 40 may be formed from a high flex modulus polyether block amide, such as PEBAX®, which is manufactured by the Atofina Company. Polyether block amide provides a variety of characteristics that may benefit footwear 10, including high impact resistance at low temperatures, few property variations in the temperature range of −40 degrees Celsius to positive 80 degrees Celsius, resistance to degradation by a variety of chemicals, and low hysteresis during alternative flexure. Furthermore, pivot element 40 may be formed from a polybutylene terephthalate, such as HYTREL®, which is manufactured by E.I. duPont de Nemours and Company. Composite materials may also be formed by incorporating glass fibers or carbon fibers into the polymer materials discussed above in order to enhance the strength of pivot element 40.

Figure 5A:
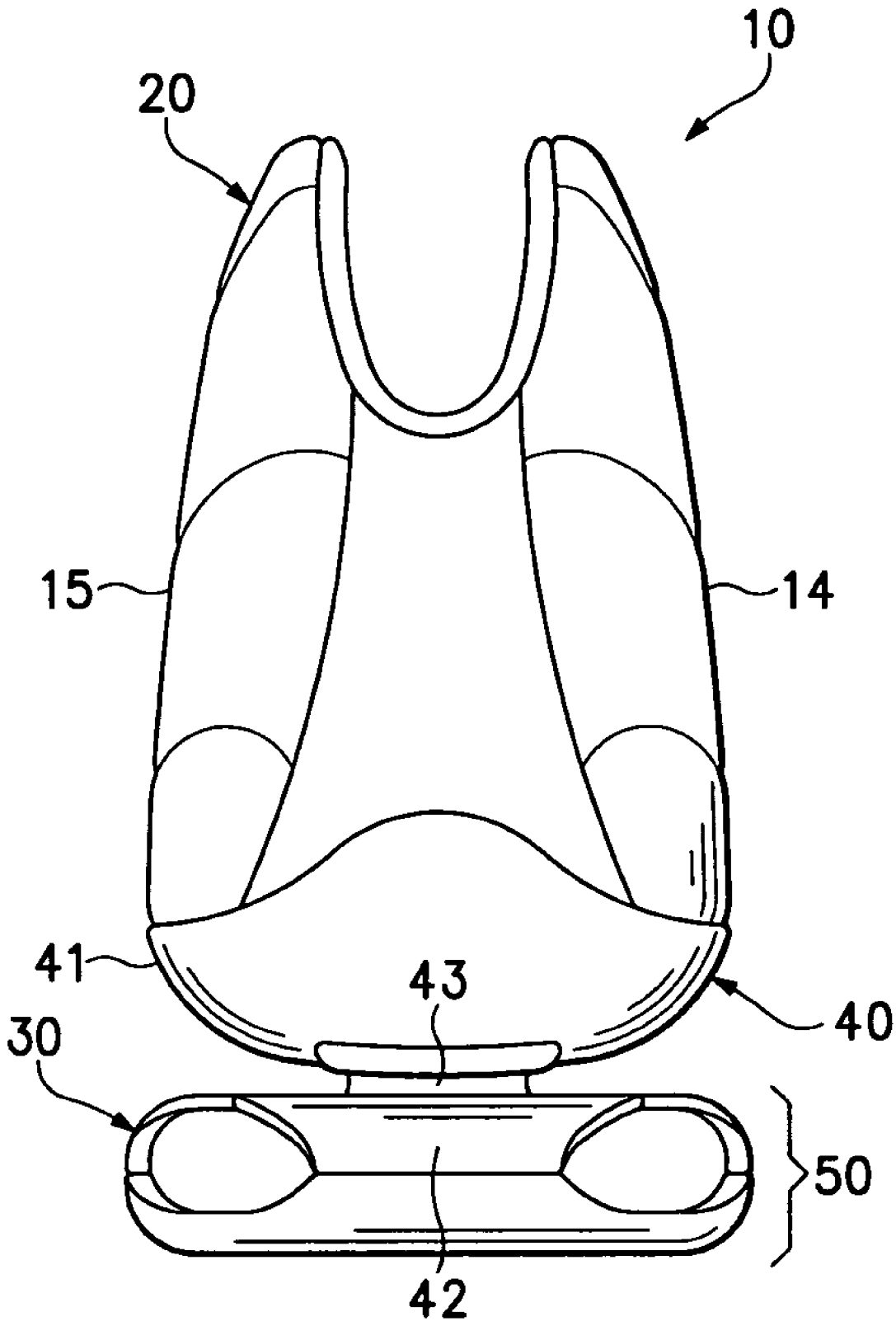
FIG. 5A-5C are rear elevational views of the article of footwear in various configurations.
Figure 5B:
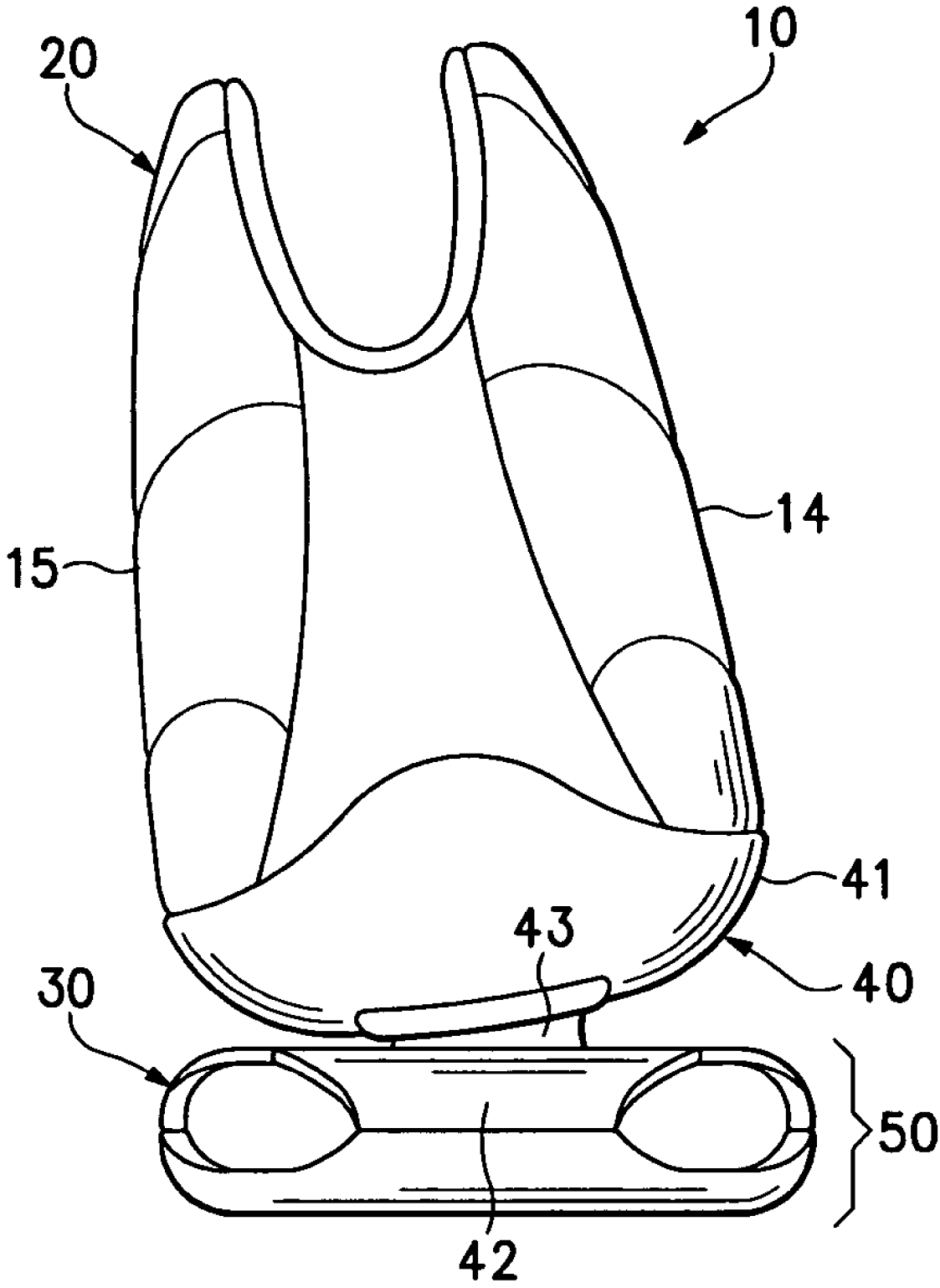
Figure 5C:
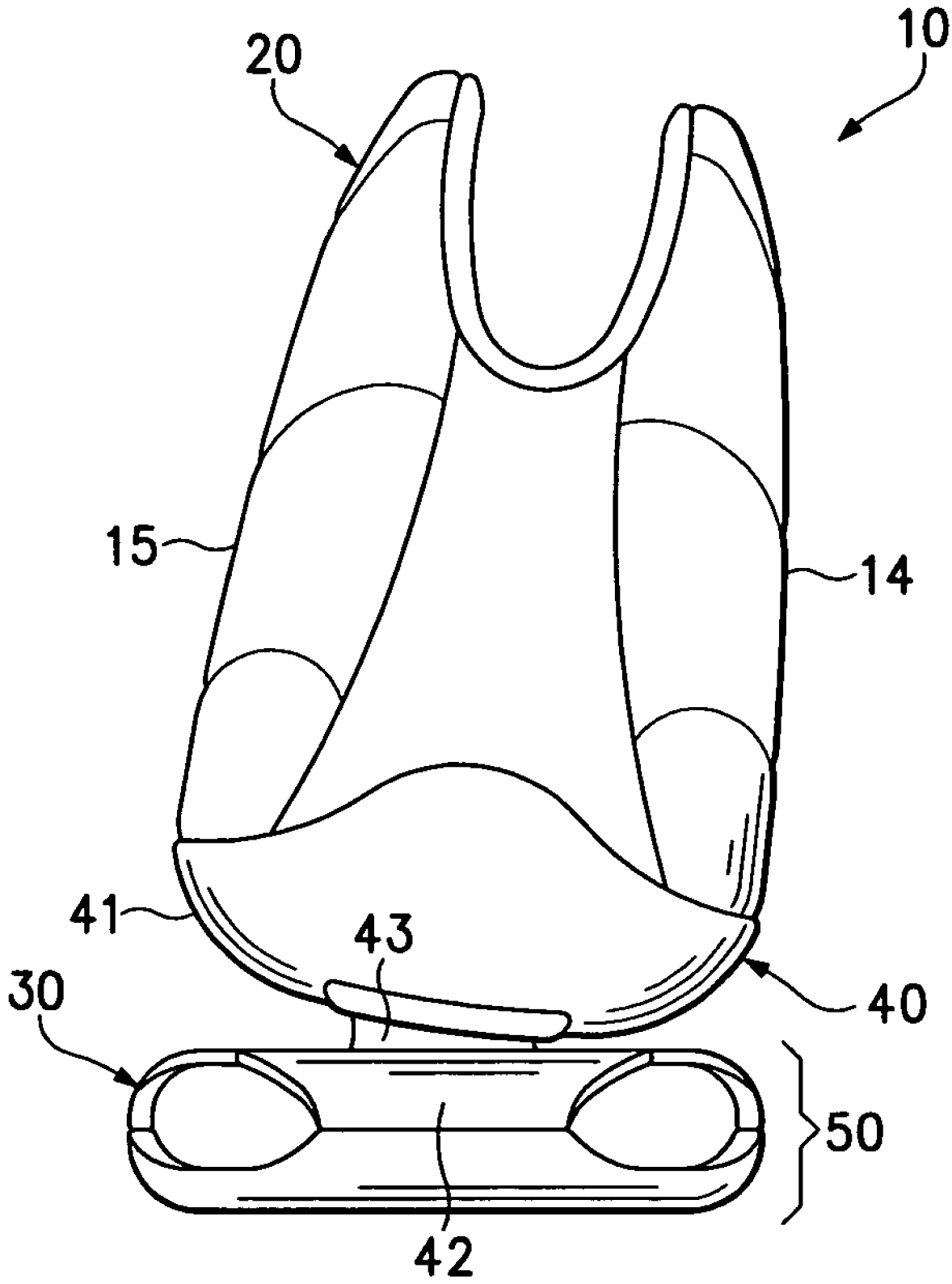

The manner in which pivot element 40 facilitates the pivoting movement will now be discussed with reference to FIGS. 5A-5C. For purposes of reference, a combination of midsole element 31*b*, outsole element 32*b*, and lower support 42 will be referred to as a sole element 50. Accordingly, coupling 43 is the only attachment point between sole element 50 and a remainder of footwear 10, which includes upper 20. With reference to FIG. 5A, footwear 10 is depicted in a configuration wherein sole element 50 is generally aligned with the remainder of footwear 10. In some conventional articles of footwear, the sole structures are secured to the uppers in a manner that resists independent movement between the uppers and the sole structures. The uppers and sole structures of these conventional articles of footwear are, therefore, generally aligned in a manner that is similar to FIG. 5A. With reference to FIGS. 5B and 5C, however, the remainder of footwear 10 is angled with respect to sole element 50. More particularly, FIG. 5B depicts a configuration wherein the remainder of footwear 10 is angled toward lateral side 14, and FIG. 5C depicts a configuration wherein the remainder of footwear 10 is angled toward medial side 15. Accordingly, coupling 43 of pivot element 40 permits side-to-side pivoting between upper 20 and sole element 50.

During the game of basketball or other athletic activities, an individual may make various cutting motions, which are relatively quick direction changes involving movement in a sideways direction. From a kinematic standpoint, cutting motions involve two components: (a) ceasing movement in a first direction and (b) initiating movement in a different second direction. In order to perform a cutting motion, the outsole of an article of footwear engages the ground such that frictional forces prevent or substantially reduce movement between the footwear and the ground. More particularly, the frictional forces that limit movement between the footwear and the ground allow the individual to cease movement in the first direction and then initiate movement in the second direction.

The frictional forces between the footwear and the ground at least partially depend upon the surface area of the outsole that is in contact with the ground. In general, a greater area of contact between the outsole and the ground results in greater frictional forces, and a lesser area of contact between the outsole and the ground results in lesser frictional forces. The pivoting motion between sole element 50 and the remainder of footwear 10 permits outsole element 32*b* to fully contact the ground even when upper 20 is angled with respect to the ground, as depicted in FIGS. 5B and 5C. In comparison with some conventional articles of footwear that resist independent movement between the uppers and the sole structures, footwear 10 is structured to permit a greater area of outsole element 32*b* to make contact with the ground in situations where upper 20 is angled with respect to the ground.

The pivoting motion between sole element 50 and the remainder of footwear 10, and the corresponding greater area of contact between outsole element 32*b* and the ground, have the potential to result in decreased time intervals for performing a cutting motion. The time interval in which the individual may transition from movement in the first direction to movement in the second direction at least partially depends upon the orientation of the leg, including the ankle, lower leg, knee, and upper leg. The pivoting motion in footwear 10 at least partially decouples the position of sole element 50 from the orientation of the leg. That is, sole element 50 may rotate or otherwise pivot independent of the leg to place outsole element 32*b* in contact with the ground. This permits the leg to achieve a more optimum position for performing a cutting motion while ensuring that outsole 32*b* is making full contact with the ground. Accordingly, decoupling sole element 50 from the orientation of the leg has the potential to result in decreased time intervals for performing the cutting motion.

The degree to which upper 20 pivots relative to sole element 50 depends upon various factors that include the materials from which pivot element 40 is fashioned and the overall structure of pivot element 40 and other portions of footwear 10. The width of coupling 43 may be approximately one-third the overall width of lower support 42 and sole element 50. Given that the overall width of lower support 42 and sole element 50 extends approximately from lateral side 14 to medial side 15, then the width of coupling 43 may extend through one-third of this distance. In other embodiments, however, the width of coupling 43 may range from approximately one-eighth to three-quarters the overall width of lower support 42 and sole element 50, for example. The dimension of the space between upper support 41 and lower support 42 also has relevance to the degree to which upper 20 pivots relative to sole element 50. As noted above, the space may range from one to twenty millimeters, for example. In some embodiments, sole element 50 may have a vertical thickness of 27 millimeters and the space may have a dimension of 5 millimeters, for example. In this scenario, the space comprises less than one-fifth of the total distance between the lower surface of upper support 41 and the lower surface of outsole element 32*b*. By modifying the dimensions associated with pivot element 40 and sole element 50, for example, degree to which upper 20 pivots relative to sole element 50 may be modified.

Figure 6:
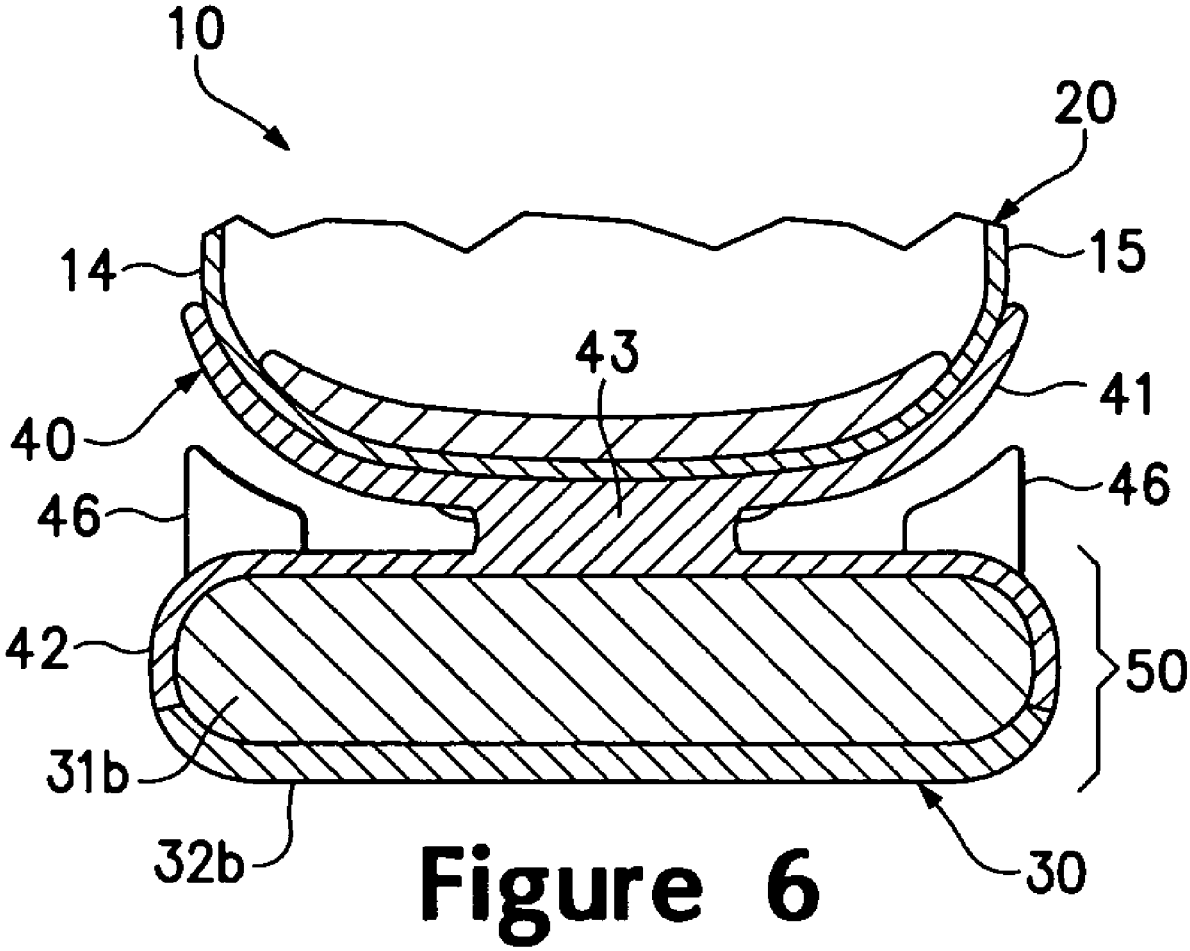
FIG. 6 is an alternate cross-sectional view corresponding with FIG. 4B.

An additional manner of controlling the degree to which upper 20 pivots relative to sole element 50 involves the use of limiting structures. With reference to FIGS. 1, 2, and 4A, for example, a limiter 45 is positioned in heel region 13 and rearward of coupling 43. As discussed above, coupling 43 permits some degree of pivoting motion in the forward-rearward direction. Limiter 45, however, further limits the degree of pivoting motion in the rearward direction by reducing the dimensions of the space between upper support 41 and lower support 42. A similar concept may be applied to limit pivoting in the side-to-side direction (i.e., toward either of lateral side 14 and medial side 15). With reference to FIG. 6, a pair of limiters 46 are located on opposite sides of coupling 43. As with limiter 45, limiters 46 limit the degree of pivoting motion in the side-to-side direction by reducing the dimensions of the space between upper support 41 and lower support 42.

Limiter 45 is depicted as being secured to upper support 41 and unsecured to lower support 42. This configuration permits pivoting in the forward direction without hindrance from limiter 45. Similarly, limiters 46 are depicted as being secured to lower support 42 and unsecured to upper support 41. When upper 20 pivots toward lateral side 14, for example, the limiter 46 adjacent to lateral side 45 limits the degree of pivoting toward lateral side 45. Given that the limiter 46 adjacent to medial side 15 is not secured to upper support 41, this limiter 46 does not hinder pivoting toward lateral side 45. Rather the degree to which pivoting toward lateral side 14 is limited is primarily a function of the characteristics of the limiter 46 adjacent to lateral side 14.

Limiters 45 and 46 may be formed from the material of pivot element 40. As an alternative, various compressible materials, such as polymer foam, may be utilized for limiters 45 and 46. In comparison with the material of pivot element 40, a polymer foam may be more compressible. In some embodiments, each of limiters 46 may be formed from a polymer foam material with different compressibilities. For example, the limiter 46 adjacent to lateral side 14 may be formed of a polymer foam that is less compressible than a polymer foam forming the limiter 46 adjacent to medial side 15. In addition, to polymer foam materials, springs or other compressible structures may be utilized for limiters 46.

Figure 7:
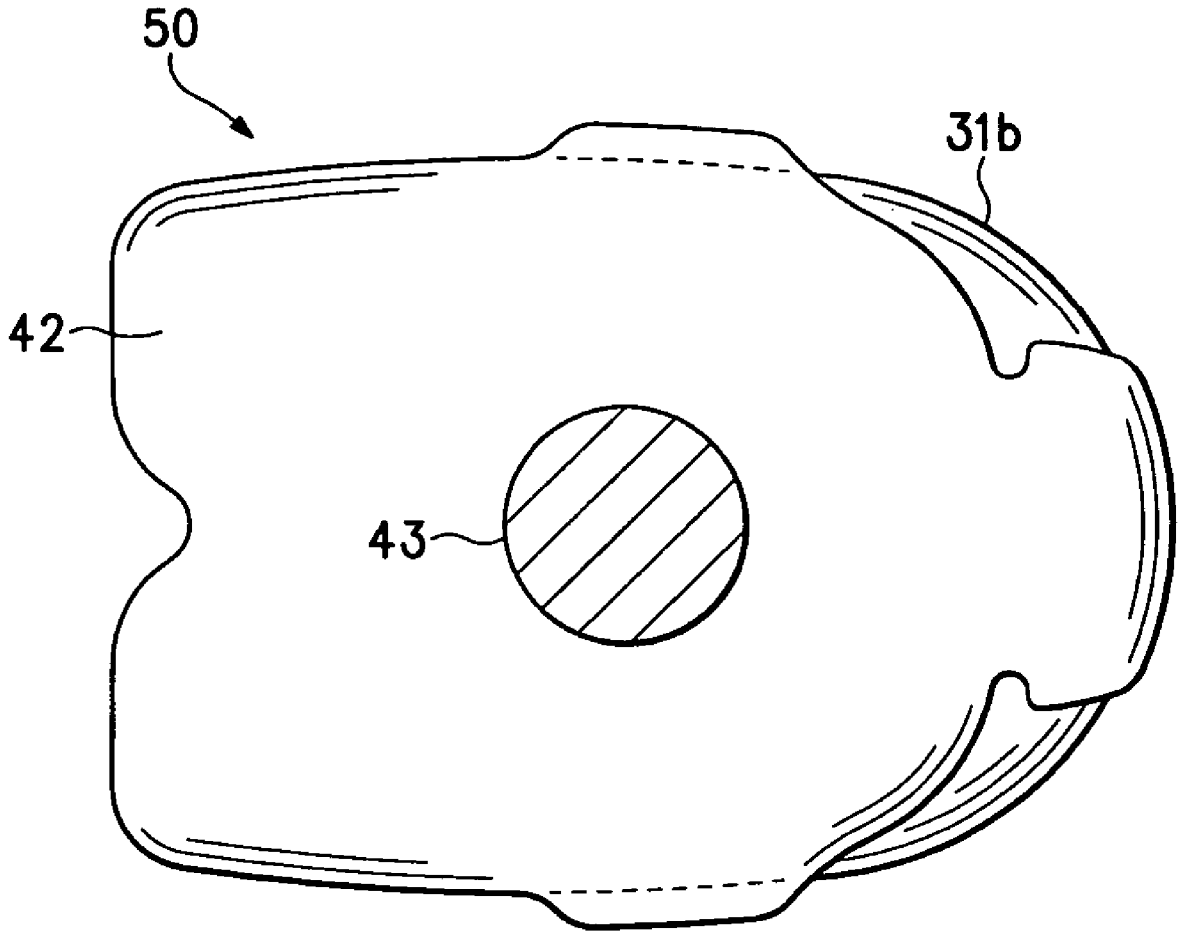
FIG. 7 is an alternate cross-sectional view corresponding with FIG. 4D.

As discussed above, the shape of coupling 43 has an effect upon the direction in which pivoting occurs. In FIG. 4D, coupling 43 is depicted as having a length that is greater than a width. This configuration facilitates pivoting in the side-to-side direction, while limiting pivoting in the forward-rearward directions. More particularly, the forces that induce pivoting in the side-to-side direction are less than the forces that induce pivoting in the forward-rearward direction. With reference to FIG. 7, coupling 43 is depicted as having a circular configuration that would facilitate pivoting in any direction. In further embodiments, coupling 43 may have a variety of shapes, including triangular, square, rectangular, elliptical, or hexagonal, for example. Accordingly, the shape of coupling 43 may be selected to facilitate pivoting in a variety of directions.

Figure 8:
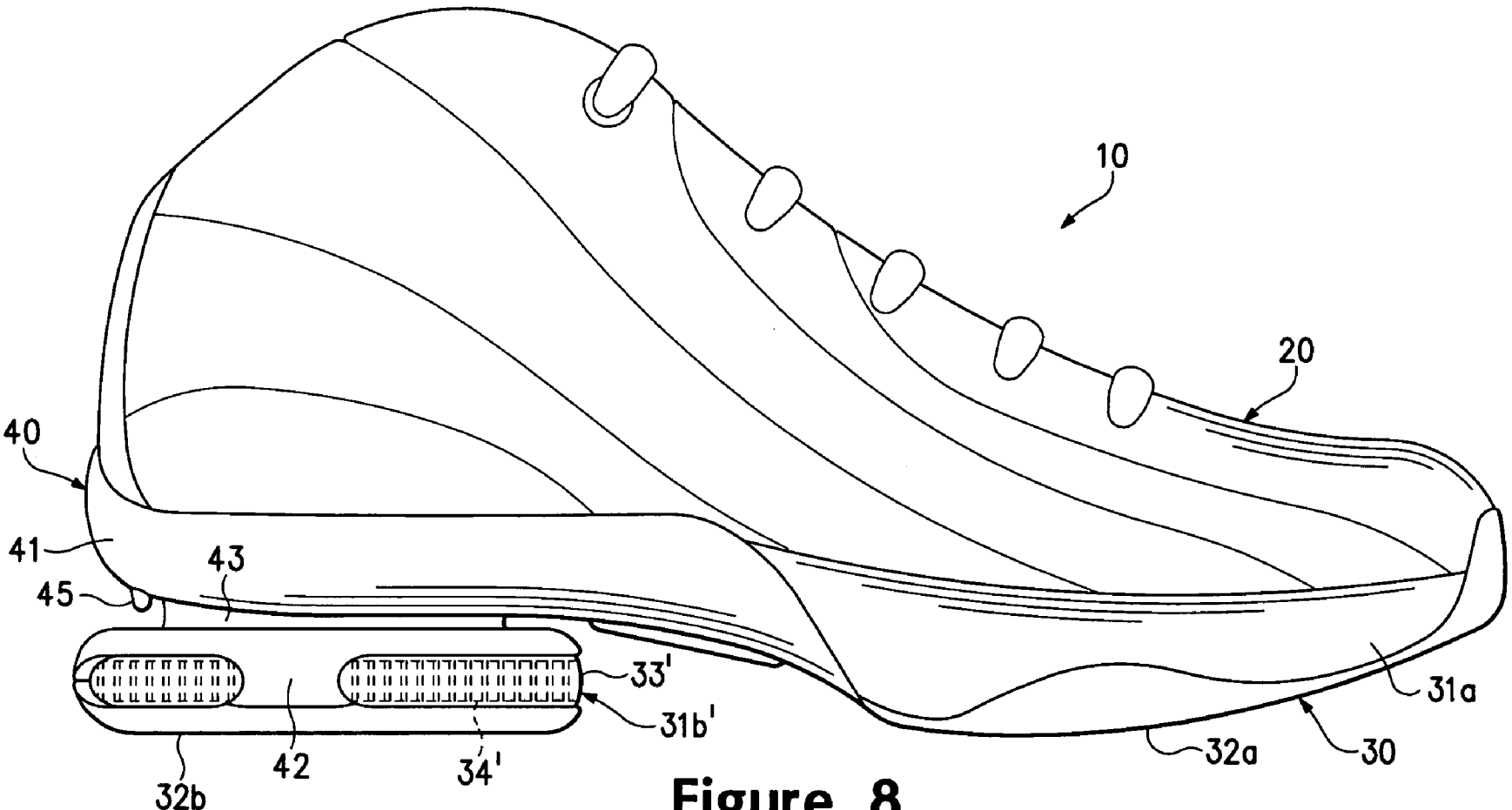
FIG. 8 is a lateral side elevational view of another article of footwear.

The polymer foam material of midsole element 31*b*, as discussed above, may incorporate a fluid-filled chamber to further enhance the ground reaction force attenuation characteristics of sole structure 30. With reference to FIG. 8, sole structure 30 is depicted as including a midsole element 31*b*' with the configuration of a fluid-filled chamber. In general, midsole element 31*b*' has an outer barrier 33' and a tensile member 34', as taught by U.S. Pat. Nos. 5,993,585 and 6,119,371, both issued to Goodwin et al., and U.S. Pat. No. 6,837,951 to Rapaport, for example. Accordingly, outer barrier 33' is substantially impermeable to a fluid contained by midsole element 31*b*', and tensile member 34' is located within outer barrier 33' and secured to opposite surfaces of outer barrier 33' to restrain outward movement of the surfaces. A variety of other configurations of fluid-filled chambers are also suitable for midsole element 31*b*'.

Figure 9:
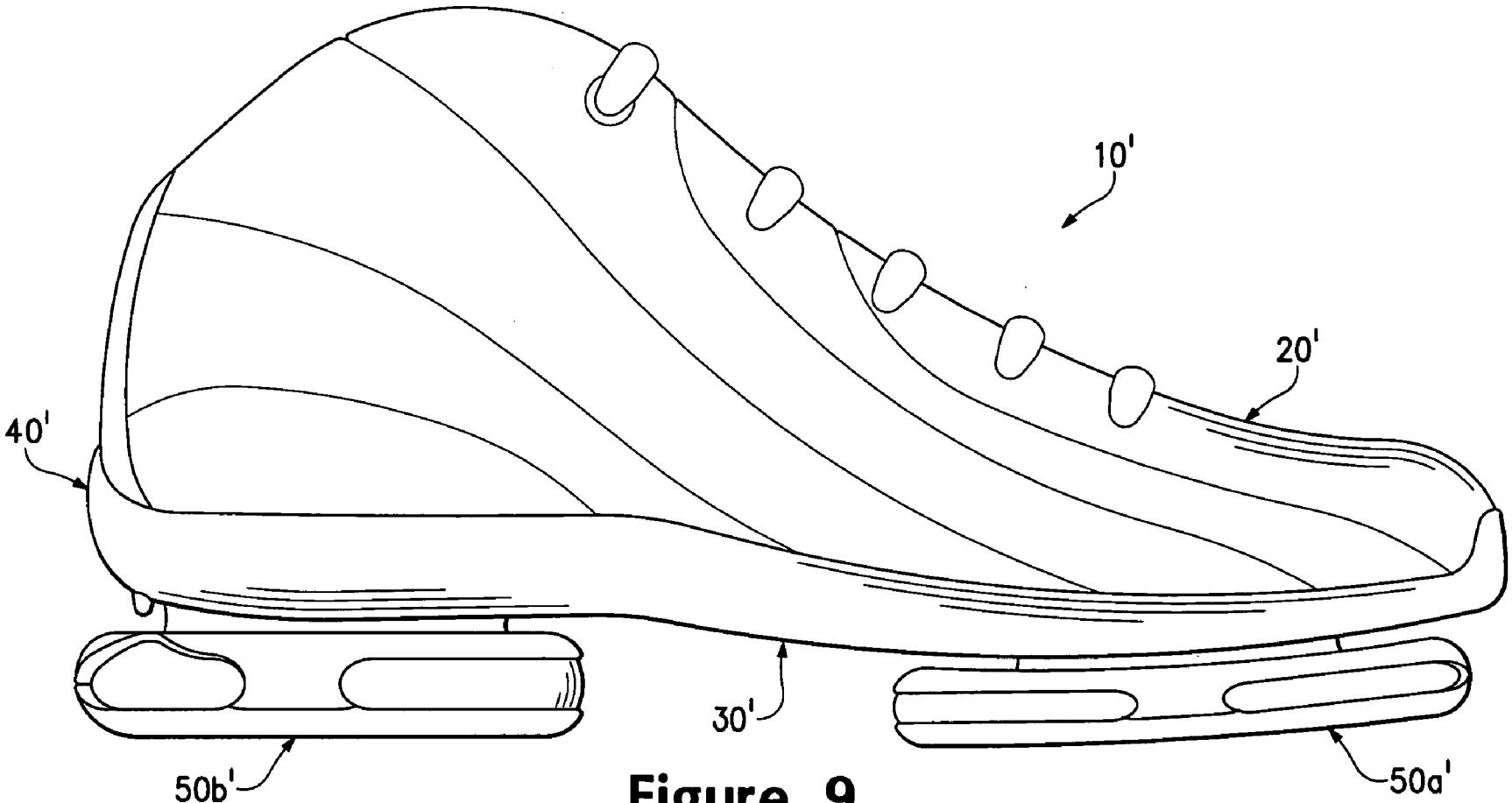
FIG. 9 is a lateral side elevational view of yet another article of footwear.

Footwear 10 is disclosed as having a configuration wherein sole element 50 is primarily located in heel region 13. With reference to FIG. 9, an article of footwear 10' is depicted as having an upper 20' and a sole structure 30'. Sole structure 30' includes a pivot element 40' that extends through substantially all of a length of footwear 10'. Pivot element 40' has a configuration that forms a sole elements 50*a*' in the forefoot region and another sole element 50*b*' in the heel region. Accordingly, footwear within the scope of the present invention may include multiple pivoting sole elements. Furthermore, and as an alternative, the footwear may have a configuration wherein the only sole element is located in the forefoot region.

The invention is disclosed above and in the accompanying drawings with reference to a variety of embodiments. The purpose served by the disclosure, however, is to provide an example of the various features and concepts related to aspects of the invention, not to limit the scope of aspects of the invention. One skilled in the relevant art will recognize that numerous variations and modifications may be made to the embodiments described above without departing from the scope of the invention, as defined by the appended claims.

That which is claimed is:

1. An article of footwear having an upper and a sole structure secured to the upper, the sole structure comprising:

a sole element spaced from a remainder of the footwear to define an air gap between a portion of the sole element and the remainder of the footwear, the sole element including:

an upper surface, a lower surface positioned opposite the upper surface to form at least a portion of a ground-contacting surface of the footwear, and a side surface extending between the upper surface and the lower surface to define a periphery of the sole element; and a coupling extending upward from the upper surface of the sole element to join the sole element with the remainder of the footwear, the coupling being spaced inward from the periphery of the sole element, and the coupling being an only attachment point between the sole element and the remainder of the footwear.

2. The article of footwear recited in claim 1, wherein the coupling is joined to a central area of the upper surface.

3. The article of footwear recited in claim 1, wherein at least one of a foam element and a fluid-filled bladder are positioned between the upper surface and the lower surface.

4. The article of footwear recited in claim 1, wherein the lower surface is an outsole of the footwear.

5. The article of footwear recited in claim 1, wherein a length dimension of the coupling is greater than a width dimension of the coupling.

6. The article of footwear recited in claim 5, wherein the length dimension extends in a direction that is substantially parallel to a longitudinal axis of the footwear.

7. The article of footwear recited in claim 1, wherein a length dimension of the coupling is substantially equal to a width dimension of the coupling.

8. The article of footwear recited in claim 1, wherein at least one limiter is positioned between the upper surface and the remainder of the footwear, the limiter being secured to one of the upper surface and the remainder of the footwear and unsecured to another of the upper surface and the remainder of the footwear.

9. The article of footwear recited in claim 8, wherein the limiter is formed of a compressible material.

10. The article of footwear recited in claim 1, wherein a support is secured to the upper and is positioned above the upper surface of the sole element, the coupling being formed of unitary construction with both of the support and the upper surface.

11. The article of footwear recited in claim 1, wherein the sole element is at least partially located in a heel region of the footwear.

12. The article of footwear recited in claim 1, wherein the sole element is at least partially located in a forefoot region of the footwear.

13. The article of footwear recited in claim 1, wherein the sole element is at least partially located in a heel region of the footwear, and another sole element is at least partially located in a forefoot region of the footwear.

14. The article of footwear recited in claim 1, wherein the coupling forms a pivot point for the upper relative to the sole element.

15. The article of footwear recited in claim 1, wherein the upper surface is substantially parallel to a portion of the upper.

16. An article of footwear having an upper and a sole structure secured to the upper, the sole structure comprising:

a first support secured to the upper and extending in a direction between a medial side and a lateral side of the footwear;

a second support that is substantially aligned with a portion of the first support, the second support being spaced from the first support and positioned below the first support, said second support having a surface facing toward said first support; and a coupling extending between the first support and the said surface of second support to form an only attachment point between the first support and the second support, the coupling being spaced inward from each of the medial side and the lateral side of the footwear, and the coupling being formed of unitary construction with each of the first support and the second support.

17. The article of footwear recited in claim 16, wherein the coupling is spaced inward from a rear surface of the footwear.

18. The article of footwear recited in claim 16, wherein the coupling is spaced inward from all edges of the second support and is positioned at a central area of the second support.

19. The article of footwear recited in claim 16, wherein at least one of a foam element and a fluid-filled bladder are secured to a lower surface of the second support.

20. The article of footwear recited in claim 19, wherein an outsole is secured to a lower surface of the at least one of the foam element and the fluid-filled bladder.

21. The article of footwear recited in claim 16, wherein an outsole is secured below the second support.

22. The article of footwear recited in claim 16, wherein a length dimension of the coupling is greater than a width dimension of the coupling.

23. The article of footwear recited in claim 22, wherein the length dimension extends in a direction that is substantially parallel to a longitudinal axis of the footwear.

24. The article of footwear recited in claim 16, wherein a length dimension of the coupling is substantially equal to a width dimension of the coupling.

25. The article of footwear recited in claim 16, wherein at least one limiter is positioned between the first support and the second support, the limiter being secured to one of the first support and the second support and unsecured to another of the first support and the second support.

26. The article of footwear recited in claim 25, wherein the limiter is formed of a material with greater compressibility than a material of the first support and the second support.

27. An article of footwear having an upper and a sole structure secured to the upper, the sole structure comprising:

a first support positioned adjacent to the upper and located to extend under a foot received by the upper;

a sole element spaced from the first support, the sole element having:

a second support forming an upper surface of the sole element, the second support being substantially parallel to a portion of the first support, an outsole forming a lower surface of the sole element, the lower surface being positioned opposite the upper surface to form at least a portion of a ground-contacting surface of the footwear, a force attenuating element positioned between the second support and the outsole, and a side surface extending between the upper surface and the lower surface to define a periphery of the sole element, the side surface being formed by at least one of the second support, the outsole, and the force attenuating element; and a coupling that joins the first support and the sole element, the coupling being formed of unitary construction with the first support and the second support, the coupling extending upward from a central area of the second support that is spaced inward from the periphery of the sole element, and the coupling being an only attachment point between the sole element and the first support, a length dimension of the coupling being greater than a width dimension of the coupling.

28. The article of footwear recited in claim 27, wherein the length dimension extends in a direction that is substantially parallel to a longitudinal axis of the footwear.

29. The article of footwear recited in claim 27, wherein at least one limiter is positioned between the first support and the second support, the limiter being secured to one of the first support and the second support and unsecured to another of the first support and the second support.

30. The article of footwear recited in claim 29, wherein the limiter is formed of a material with greater compressibility than the first support and the second support.

31. The article of footwear recited in claim 27, wherein the sole element is at least partially located in a heel region of the footwear.

32. The article of footwear recited in claim 31, wherein another sole element is at least partially located in a forefoot region of the footwear.

33. The article of footwear recited in claim 27, wherein the force attenuating element is at least one of a foam element and a fluid-filled bladder.

34. The article of footwear recited in claim 27, wherein the air gap ranges from 1 to 20 millimeters.

35. The article of footwear recited in claim 27, wherein the air gap comprises less than one-fifth of the total distance between the remainder of the footwear and the ground-contacting surface.

36. The article of footwear recited in claim 27, wherein the coupling ranges from approximately one-eighth to approximately three-quarters of a width of the sole element.

37. The article of footwear recited in claim 16, wherein the air gap ranges from 1 to 20 millimeters.

38. The article of footwear recited in claim 16, wherein the air gap comprises less than one-fifth of the total distance between the remainder of the footwear and the ground-contacting surface.

39. The article of footwear recited in claim 16, wherein the coupling ranges from approximately one-eighth to approximately three-quarters of a width of the sole element.

40. The article of footwear recited in claim 1, wherein the air gap ranges from 1to 20 millimeters.

41. The article of footwear recited in claim 1, wherein the air gap comprises less than one-fifth of the total distance between the remainder of the footwear and the ground-contacting surface.

42. The article of footwear recited in claim 1, wherein the coupling ranges from approximately one-eighth to approximately three-quarters of a width of the sole element.

* * * * *

UNITED STATES PATENT AND TRADEMARK OFFICE

CERTIFICATE OF CORRECTION

PATENT NO. : 7,395,616 B2
APPLICATION NO. : 11/251545
DATED : July 8, 2008
INVENTOR(S) : Kevin Patrick Fallon It is certified that error appears in the above-identified patent and that said Letters Patent is hereby corrected as shown below:

Column 9, lines 53 and 54, replace "and the said surface of second support" with --and said surface of the second support--.

Signed and Sealed this

Eighteenth Day of November, 2008

JON W. DUDAS
*Director of the United States Patent and Trademark Office*